US006642818B2

(12) United States Patent
Liu et al.

(10) Patent No.: US 6,642,818 B2
(45) Date of Patent: Nov. 4, 2003

(54) LOOP COUPLED MICROWAVE CAVITY

(75) Inventors: Ji-Chyun Liu, Tao-yuan (TW); Chung-Chi Chang, Hsinchu (TW); Ju-Chi Chung, Tao-yuan (TW)

(73) Assignee: Industrial Technology Research Institute, Hsinchu (TW)

( * ) Notice: Subject to any disclaimer, the term of this patent is extended or adjusted under 35 U.S.C. 154(b) by 4 days.

(21) Appl. No.: 09/894,888

(22) Filed: Jun. 29, 2001

(65) Prior Publication Data

US 2002/0101307 A1 Aug. 1, 2002

(30) Foreign Application Priority Data

Dec. 14, 2000 (TW) ..... 89126681 A

(51) Int. Cl.[7] ..... H01P 7/06; H01P 5/103
(52) U.S. Cl. ..... 333/230; 324/639; 324/637
(58) Field of Search ..... 333/208, 230, 333/33; 324/639, 637, 642

(56) References Cited

U.S. PATENT DOCUMENTS 4,581,574 A * 4/1986 Goodman et al. ..... 324/58 A
4,996,489 A * 2/1991 Sinclair ..... 324/58 R
5,187,443 A * 2/1993 Bereskin ..... 324/639
5,714,919 A * 2/1998 Satoh et al. ..... 333/202
6,081,173 A * 6/2000 Sonoda et al. ..... 333/202

* cited by examiner

*Primary Examiner*—Robert Pascal
*Assistant Examiner*—Stephen E. Jones
(74) *Attorney, Agent, or Firm*—Rabin & Berdo, P.C.

(57) ABSTRACT

A loop coupled microwave cavity, which uses a cylindrical cavity as the main body and has a lock hole on the top of the cavity in order to connect to a loop-coupling end formed by bending the long pin of an SMA connector. The long pin of the SMA extends into the cavity through the lock hole so that the top end of the long pin will touch the inner wall of the cavity to receive a microwave signal in $TM_{012}$ mode to excite the cavity. On the other hand, the coaxial structure formed by the long pin and the lock hole is a quarter-wavelength transformer, so the SMA connector has both loop coupling and impedance transforming functions to increase the Q factor of the cavity. A diminutive sample is inserted into the cavity to perform the cavity perturbation method (CPM).

32 Claims, 4 Drawing Sheets

LOOP COUPLED MICROWAVE CAVITY

This application incorporates by reference Taiwanese application Serial No. 89126681, Filed Dec. 14, 2000.

BACKGROUND OF THE INVENTION

1. Field of the Invention

The invention relates in general to a microwave cavity, and more particularly to a cylindrical resonant cavity that can be used to measure the dielectric characteristics of various materials.

2. Description of the Related Art

The applications of microwave technology have attracted the attention of researchers and industry and these applications include: material characteristics measurement, nondestructive detecting, communication, radar, medical science, biochemistry and agriculture. Since the related research requires knowing precisely the material's dielectric characteristics, the researchers have devoted themselves to the exploration of dielectric material. This makes the development of microwave technology more prosperous.

In the electronics industry, the improvements of the microwave engineering make high frequency communication technology more advanced, from the early days of satellite transmission to the personal portable communication devices. The process of high frequency circuit fabrication is to form the layout on the circuit board first, and after the completion of the layout, the related components are assembled to complete the whole circuit. It is important to realize that since the circuit board is a kind of dielectric material and the electric characteristics are decided by the individual parameters of the dielectric material. Therefore, one must master the dielectric characteristics of the circuit board before starting the circuit design. Thus, the parameters such as permittivity, loss tangent and the Q factor are essential information to make sure the quality of the circuit board is as expected. There are many measuring techniques available for measuring the parameters of dielectric materials, for example, wave-guide method, transmission method, microstrip line method, cavity perturbation method (CPM) and quasi-optical resonator method. Among these methods, CPM and quasi-optical resonator method produce the lowest loss in measuring the loss tangent. The paragraphs below contain the explanation about the CPM.

The CPM involves placing a diminutive sample into the cavity to cause perturbation and change the resonant frequency of the cavity and its Q factor, so the dielectric characteristics of the sample can be calculated from the quantity of those changes. Since CPM is particularly suitable for measuring the dielectric materials having a high Q factor, it is favored by most researchers.

FIG. 1 illustrates the cross-sectional view of the cavity and the diminutive sample during the CPM. It can be seen from FIG. 1 that a diminutive sample 130 is placed into a cavity 100 which is then excited. The dielectric characteristics of the diminutive sample 130 can be calculated from the volumes of the sample 130 and the cavity 100, and the changes in resonant frequency and the Q factors, which can be derived from comparing the measurements before and after the insertion of the sample 130.

FIG. 2A presents a cylindrical cavity with one end being a top end 200*a* and the other a bottom end 200*b* with both ends sealed to form a closed space between the top end 200*a* and the bottom end 200*b*. FIG. 2B is a cross-sectional view of the cavity 200 taken along line 2B—2B in FIG. 2A.

Referring to FIG. 2B, one must excite the cavity 200 and measure the resonant frequency and the Q factor of the cavity 200 before performing the CPM. Then a diminutive sample (not illustrated in FIG. 2B) will be placed into the cavity 200 in a manner that is shown in FIG. 1; after the insertion of the sample, the cavity 200 will be excited again in order to measure the changed resonant frequency and the Q factor.

According to theory, the resonant frequency of the cavity in $TM_{012}$ mode is:

$$f_{012} = \frac{c}{2\pi}\sqrt{\left(\frac{2.405}{a}\right)^2 + \left(\frac{2\pi}{l}\right)^2}$$

$$c = 3 \times 10^8 \text{ m/s}$$

$$a = \text{radius of the inner wall of the activity}$$

$$l = \text{length of the inner wall of the activity}$$

If a=1.85 cm, and l=7.7 cm, then the resonant frequency will be $$f_{012}=7.33 \text{ GHz.}$$

After the insertion of the diminutive sample, the resonant frequency and the Q factor will change and the dielectric characteristics of the diminutive sample can be derived from these changes. It is important to note that the essential condition of the CPM is that the Q factor of the cavity must be higher than that of the diminutive sample; otherwise, the accuracy of the measurement will be affected.

Traditionally, the high Q factor cavity is in $TM_{010}$ mode and is excited by transmission. The Q factor of this kind is under 5000 due to the restraint of the cavity structure. In other words, when the Q factor of the measured dielectric material is greater than 5000, the resulting measurements will not be accurate; thus, it will be meaningless to carry out the CPM.

SUMMARY OF THE INVENTION

It is therefore an object of the invention to provide a loop coupled microwave cavity apparatus, which can be excited by $TM_{012}$ mode microwave signal, in order to provide a higher Q factor to the cavity for measuring the dielectric characteristics of the material having high Q factor.

The invention achieves the above object by providing a new loop coupled microwave cavity apparatus and its features are described in the following paragraphs.

The loop coupled microwave cavity apparatus includes a cavity and a loop coupler. In the process of making the cavity, a copper pillar is drilled to form a hollow, and a step base is made and connected tightly to the hollow in order to form the main body of the cavity apparatus. Then, a mushroom-shaped lock hole is made on the top of the cavity apparatus by drilling. The lock hole is to be used for the insertion of the loop coupler. The loop coupler has a receiving end and an excitation portion, wherein the receiving end is connected to an outside circuit in order to receive a microwave signal from the outside circuit while the excitation portion is connected to the inner wall of the cavity in order to excite the cavity. In practice, one can use an SMA connector having a long pin as the loop coupler. The connecting part can be used as a receiving end and the tail of the long pin is bent to form the excitation portion. The long pin of the SMA connector is placed into the cavity through the lock hole while the end of the tail of the long pin is connected to the inner wall of the cavity; then a microwave signal in $TM_{012}$ mode can be fed to excite the cavity. On the other hand, the long pin and the lock hole form a coaxial structure, which can be viewed as a quarter-wavelength transformer. Therefore, the SMA connector serves not only as a loop coupler but also as an impedance transformer to increase the Q factor of the cavity. Furthermore, one side of the cavity can be drilled to form a side hole through which the diminutive sample can be placed into the cavity to perform the CPM.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

The geometric structure of the cavity can be either rectangular or cylindrical but the cylindrical cavity is preferred in practical applications since the Q factor of a cylindrical cavity is higher than that of the rectangular cavity; among the cylindrical cavity, the $TM_{01n}$ and $TE_{01n}$ modes are frequently used. According to the references, a flat cylindrical cavity's (2a/f>1, a=radius of the cavity, l=length of the cavity) $TE_{01n}$ mode has a Q factor much higher than that of the $TM_{01n}$ mode while a long cylindrical cavity's (2a/e<1) $TE_{01n}$ and $TM_{01n}$ mode have Q factors that are close to each other. Thus, a long cylindrical cavity is often used in CPM. Ideally, the Q factor should be very high if there is no change in the geometric structure of the cavity. However, the addition of the base and coupler inevitably changes the original geometric structure of the cavity, resulting in the degradation of the Q factor. As such, if a high Q factor is required, one must keep the cavity as close to its original structure as possible.

In order to preserve the original structure as much as possible, the invention provides a loop coupled microwave cavity that uses a reflection coupler to feed a microwave signal into the cavity. This reflection coupler has an advantage over the conventional transmission coupler; it only needs one coupler to perform the operation while the conventional one needs two. In this way, the invention minimizes the changes in the geometry of the cavity needed.

Figure 1:
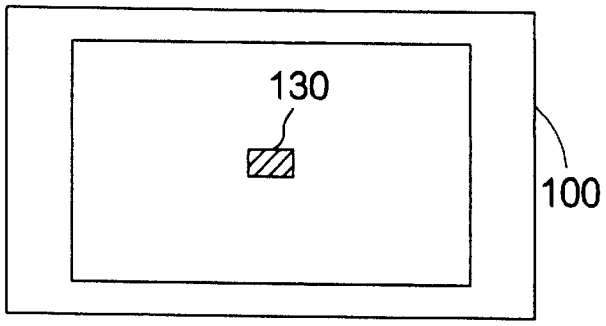
FIG. 1 (PRIOR ART)
FIG. 1 (Prior Art) illustrates a cross-sectional view of the cavity when a diminutive sample is placed into the cavity in order to perform the CPM.
Figure 2A:
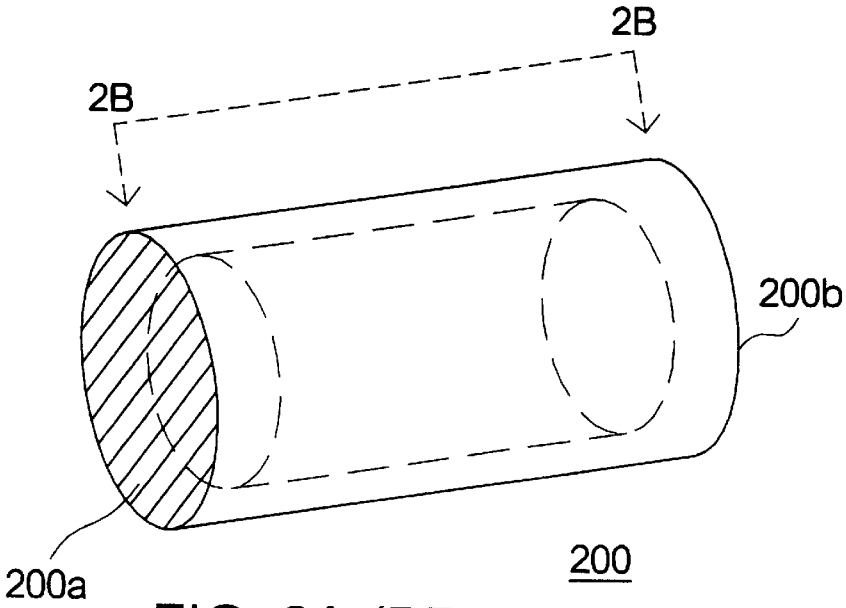
FIG. 2A (PRIOR ART)
FIG. 2A (Prior Art) shows an illustration of a cylindrical cavity.
Figure 2B:
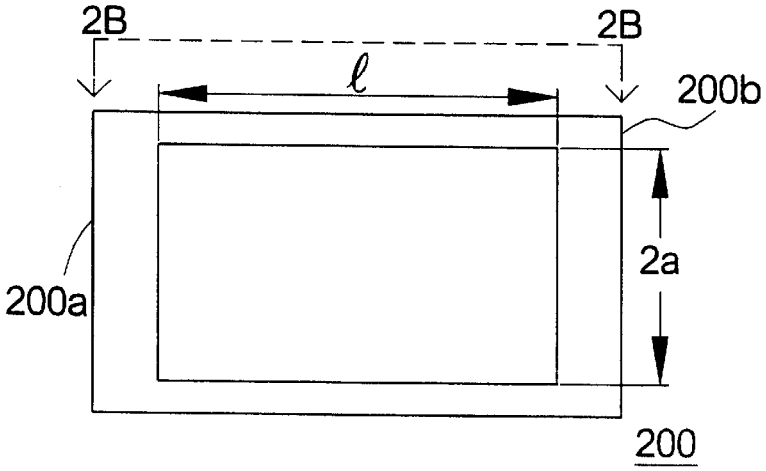
FIG. 2B (PRIOR ART)
FIG. 2B (Prior Art) depicts the cross-sectional view of the cavity that is shown in FIG. 2A.
Figure 3:
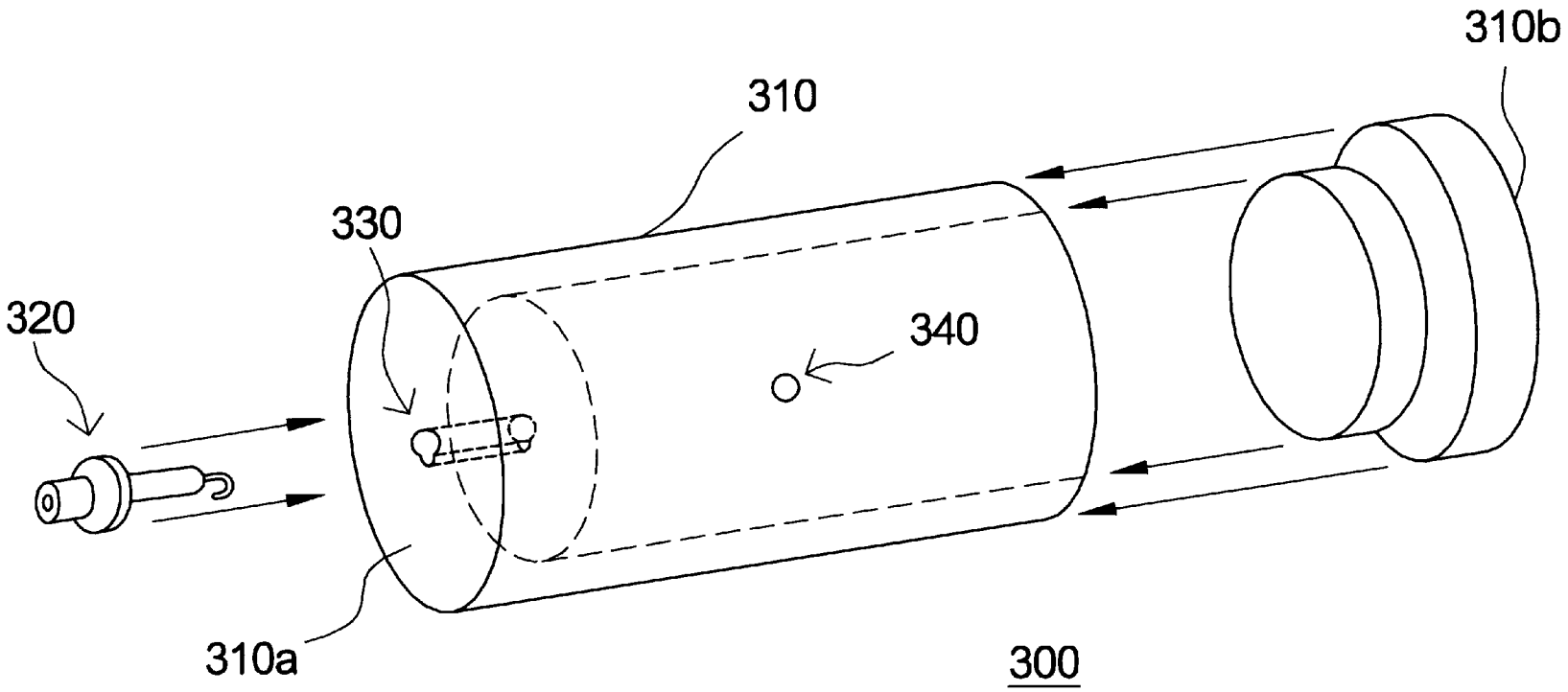
FIG. 3 shows an illustration of a loop coupled microwave cavity apparatus provided by the invention's preferred embodiment.

Referring to FIG. 3, a loop coupled microwave cavity apparatus is illustrated according to the invention's preferred embodiment. The loop coupled microwave cavity apparatus 300 includes a cavity 310 and a loop coupler 320; there is a side hole 340 communicating with the cavity 310 for inserting a diminutive sample (not illustrated in FIG. 3) into the cavity 310. Besides, a top end 310*a* of the cavity has a lock hole 330 in the cavity 310 through which a loop coupler 320 can be inserted into the cavity 310. In the process of making the cavity 310, a cylindrical metallic material, such as copper, can be used as the body of the cavity 310 and the metal is drilled to form a cavity 310. Then the same metal is used to make a step base as a bottom end 310*b* of the cavity 310 and applies the transition fit to connect the bottom end 310*b* and the cavity 310. In order to make the connection between the cavity 310 and the bottom end 310*b* of the cavity tighter, one can drill and spiral the connecting spot between the cavity 310 and the bottom end 310*b* of the cavity, then use the screw to make the connection tight in order to increase the Q factor of the cavity. The following paragraphs explain the loop coupler 320 and its connection with the main body of the cavity apparatus through the lock hole 330.

Figure 4:
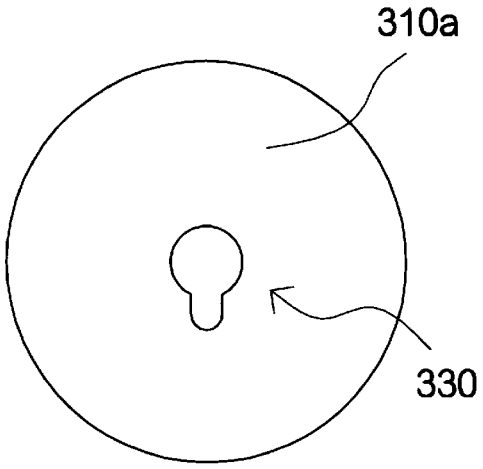
FIG. 4 shows the front view of the top end of the loop coupled microwave cavity apparatus shows in FIG. 3.

FIG. 4 presents the front view of the top end 310*a* of the cavity apparatus. As can be seen, a lock hole 330 is on a top end 310*a* and in communication with the cavity 310. The structure of the lock hole 330 is obtained by double-drilling: first, a big hole is drilled at the center of the circle and drilled through the top end 310*a*; second, a small hole is drilled at a place just next to the center of the circle and also drilled through the top end 310*a*. The two holes are partly overlapped and smoothed to make a mushroom-shaped lock hole structure, as shown in FIG. 4.

Figure 5:
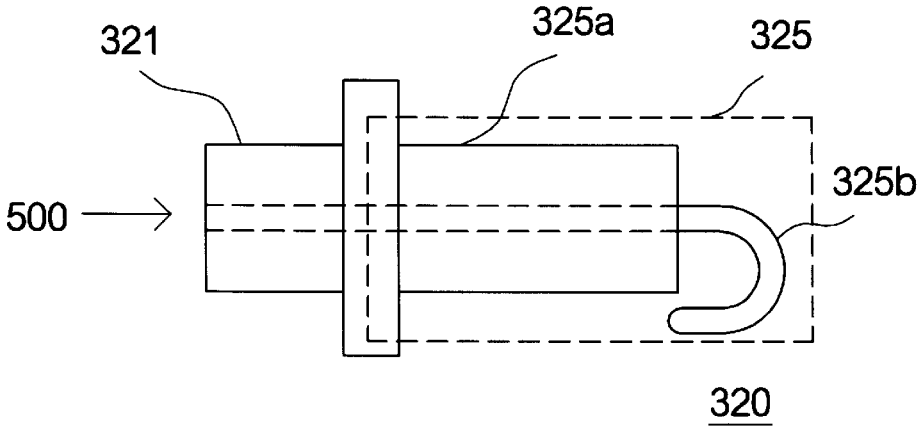
FIG. 5 shows a lateral view of the loop coupler shown in FIG. 3.

FIG. 5 illustrates a lateral view of the loop coupler 320. In general, there are several ways to excite the cavity: probe style, loop style, iris style, and so on. One must choose a style that changes the original structure as little as possible in order to preserve a high Q factor. Therefore, the invention will choose a loop style to excite the cavity and use an SMA connector as a loop coupler 320. As illustrated in FIG. 5, the SMA connector has a co-axial structure with a long pin along its axis, the long pin being covered by an insulating sleeve 325*a* made of TEFLON™, a type of fluoropolymer resin. One end of the connector can be used as a receiving end 321 and can be connected to an outside circuit (not illustrated) in order to receive a microwave signal 500; and the other end of the connector can be used as an excitation portion 325 and applies microwave signal 500 to excite the cavity 310. The top of the long pin can be bent to make a loop coupling part 325*b*. In order to enable the insulating sleeve 325*a* and the lock hole 330 to stick to each other, part of the insulating sleeve 325*a* is trimmed so that the external diameter of the insulating sleeve 325*a* will be just a little bit shorter than the internal diameter of the bigger hole of the lock hole 330. In order to make a connection between the inner wall of the cavity 310 and the loop coupler 320, the excitation portion 325 is placed in the lock hole 330 so the loop coupling part 325*b* can enter the cavity 310 through the lock hole 330. The external diameter of the insulating sleeve 325*a* and the internal diameter of the lock hole 330 are designed in such a way that they can stick to each other. Thus, the loop coupler 320 will be installed solidly in the lock hole 330 as long as the excitation portion 325 is placed into the lock hole 330. Then, by turning the loop coupler 320 around, the top end of the loop coupling part 325*b* will touch the inner wall of the top end 310*a* of the cavity. In other words, the excitation portion 325 is connected to the inner wall of the cavity 310 through the lock hole 330 so when a microwave signal 500 is received, it will be used to excite the cavity 310. Of course, one can give the loop coupler 320 a screw at the top end 310*a* of the cavity 310 to make a firmer structure.

Figure 6:
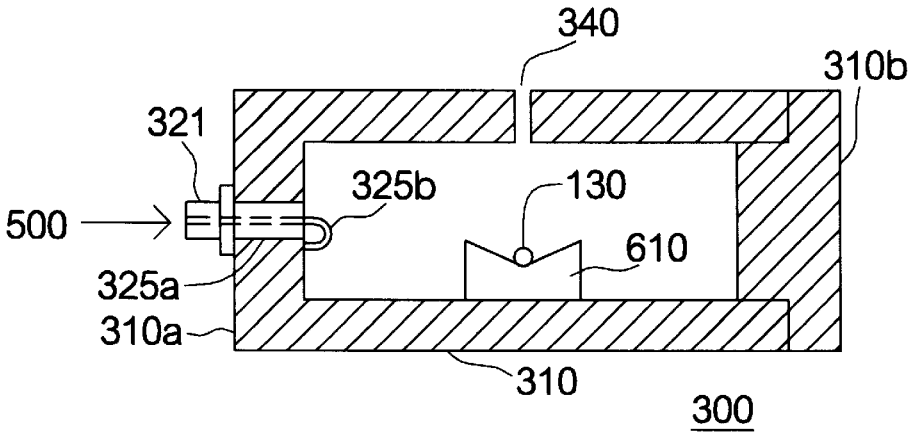
FIG. 6 shows a cross-sectional view of the loop coupled microwave cavity apparatus shown in FIG. 3, after it is assembled.

Referring to FIG. 6, a cross-sectional view of the loop coupled microwave cavity apparatus 300 is shown after it is assembled. Since the loop coupling part 325*b* uses a current to excite the cavity in order to get the TM mode, the loop coupling part 325*b* must be connected to the cavity. As illustrated, the loop coupler 320 is placed in the lock hole 330 and the loop coupling part 325*b* of the excitation portion 325 is connected to the inner wall of the cavity 310. In the process of CPM, the positioning holder 610 can be placed into the cavity 310 first, and then the cavity 310 is excited in order to measure the resonant frequency and the Q factor. The next step is to insert the diminutive sample 130 through the side hole 340 and place it on the positioning holder 610 and then the cavity 310 is excited again to take the measurements of the resonant frequency and the Q factor. The dielectric characteristics of the diminutive sample 130 can be derived from a comparison of the changes in the Q factor and the resonant frequency, which is measured before and after the insertion of the sample, and the calculation of the volumes of the sample and the cavity. The expandable polyfoam can be used as the material of the positioning holder 610 because its relative dielectric permittivity ($\epsilon_r$) is nearly one, which is the same as that of the air ($\epsilon_0$), so it will not cause much effect to the measurements.

Figure 7:
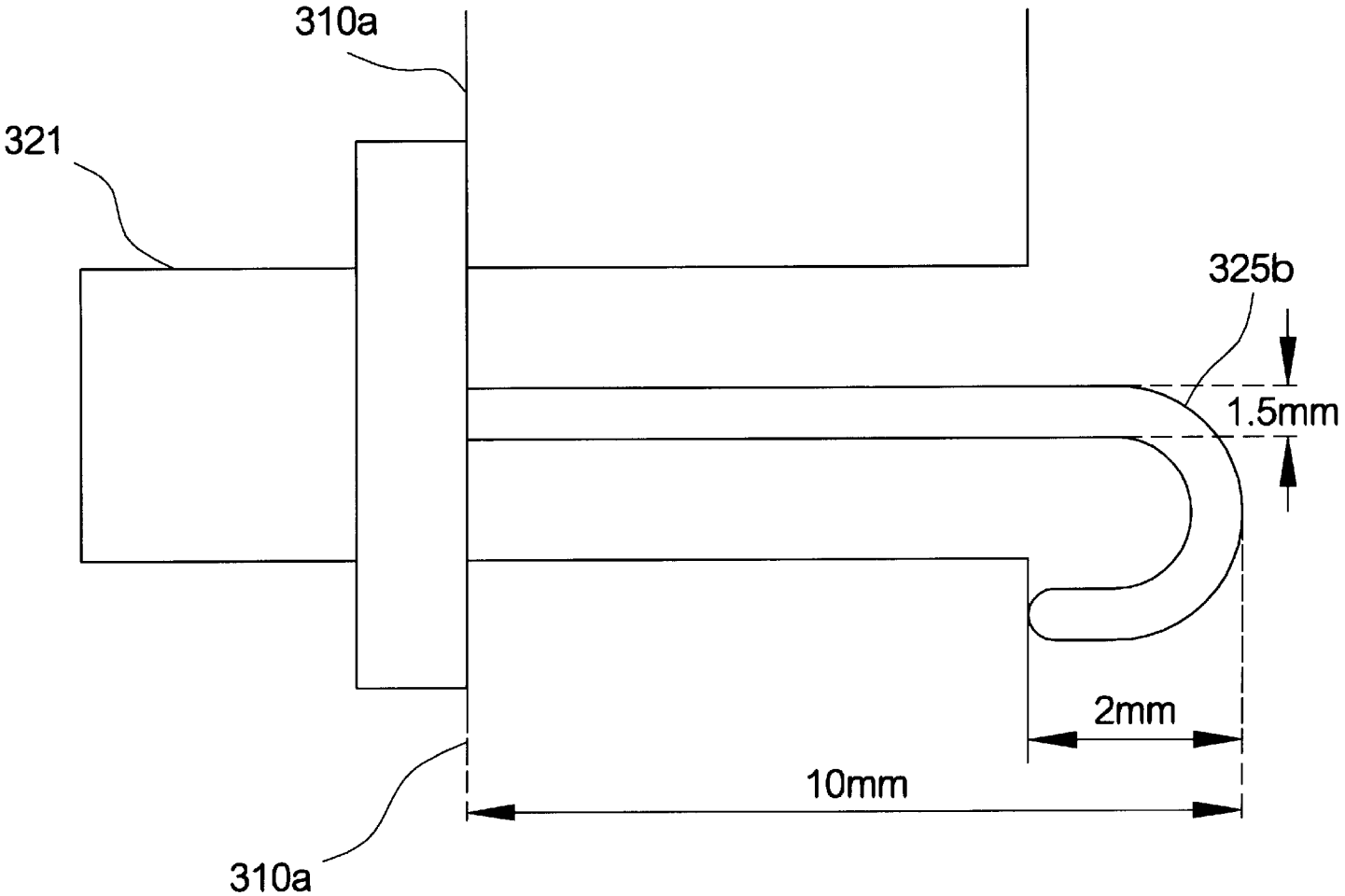
FIG. 7 shows a cross-sectional view of the connection spot of the cavity's top end and the loop coupler shown in FIG. 6.

From the cross-sectional view, it can be seen that the long pin of the SMA connector is the axis, the thickness of the top end 310*a* is thicker and the long pin is inside it, so the long pin and the lock hole form a coaxial line. This coaxial structure makes the combination of a quarter-wavelength ($\lambda/4$) transformer and the loop coupler 320 possible. Thus, the loop coupler 320 in the invention has the functions of both loop coupling and impedance transformation. Referring to FIG. 7, a cross-sectional view of the connection spot of the cavity's top end 310*a* and the loop coupler 320 is illustrated. Using FIG. 7 as an example, the bending part of the loop coupling part 325*b* is 2 mm, the length in which the long pin inserted to the cavity 310 is 10 mm and the diameter of the long pin is 1.5 mm. Therefore, the length of the long pin's central line inside the cavity 310 is 10.5 mm. If this length is seen as a quarter of the wavelength, then the frequency can be calculated as 7.4 GHz in $TM_{012}$ mode. The excitation portion 325, viewed from the receiving end 321, can be regarded as a quarter-wavelength coaxial line. At the resonant frequency, the impedance is regarded as an open circuit and $Q_e$ is infinite. In this way, the cavity retains its high Q factor. In practice, the loop coupled microwave cavity apparatus 300 in $TM_{012}$ mode has a central frequency of $f_{012}$=7.549 GHz, and a 3 dB bandwidth of BW=100 KHz, so the Q factor of the cavity in $TM_{012}$ mode is $$Q=f_{012}/BW\cong 75{,}000,$$

wherein a network analyzer HP-8510 is used to measure the characteristics of the loop coupled microwave cavity apparatus 300.

Although the Q factor of the conventional cavity in $TE_{01n}$ mode can reach 50000, it is limited to measuring liquid or circularly flat solid samples. As well, the manufacturing of such cavity is very difficult. In comparison, the invention provides a loop coupled microwave cavity apparatus that obviously outperforms the conventional device.

The preferred embodiment of the invention that has been discussed provides the following advantages:

1. a simple structure that is easy to make;
2. using a reflection style to excite the cavity to keep the cavity apparatus structure close to its original geometric structure;
3. using a loop coupler to provide impedance transformation and loop coupling in order to keep the high Q factor; and
4. in $TM_{012}$ mode, the Q factor of the cavity can be higher than 75000 in order to measure the dielectric characteristics of a high Q factor dielectric material.

It is important to know that the invention applies SMA connector as the coupler to receive microwave signal and to excite the cavity. However, the SMA connector is not the only component that can be used to perform the function.

While the invention has been described by way of example and in terms of the preferred embodiment, it is to be understood that the invention is not limited to the disclosed embodiment. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A loop coupled microwave cavity apparatus, comprising:

a cavity, wherein one end of the cavity is a top end having a lock hole; and a loop coupler placed in the lock hole and connected to the cavity, wherein the loop coupler comprises:

a receiving end for receiving a microwave signal; and an excitation portion connected to the inner wall of the cavity through the lock hole, wherein the excitation portion transmits the microwave signal and excites the cavity with the microwave signal;

wherein the loop coupled microwave cavity apparatus is excited in $TM_{012}$ mode.

2. The loop coupled microwave cavity apparatus according to claim 1, wherein the cavity has a side hole for inserting a diminutive sample into the cavity in order to measure dielectric characteristics of the diminutive sample.

3. The loop coupled microwave cavity apparatus according to claim 2, wherein the loop coupler protrudes from the lock hole into the cavity and is for impedance transforming and loop coupling.

4. The loop coupled microwave cavity apparatus according to claim 2, wherein the loop coupler is an SMA connector having a long pin to form the excitation portion.

5. The loop coupled microwave cavity apparatus according to claim 4, wherein the SMA connector is for impedance transforming and loop coupling and the long pin is bent to touch the inner wall of the cavity.

6. The loop coupled microwave cavity apparatus according to claim 2, wherein the diminutive sample is composed of a dielectric material.

7. The loop coupled microwave cavity apparatus according to claim 2, wherein the cavity is a cylinder of circular cross section and is formed of a metallic material.

8. The loop coupled microwave cavity apparatus according to claim 7, wherein the metallic material is copper.

9. The loop coupled microwave cavity apparatus according to claim 1, wherein the lock hole is a mushroom-shaped hole.

10. The loop coupled microwave cavity apparatus according to claim 1, wherein the loop coupler is for loop coupling and impedance transforming, and the excitation portion protrudes from the lock hole and is bent to touch the inner wall of the cavity.

11. The loop coupled microwave cavity apparatus according to claim 1, wherein the cavity is cylinder of circular cross section and is formed of a metallic material.

12. The loop coupled microwave cavity apparatus according to claim 1, wherein the loop coupler is an SMA connector having a long pin to form the excitation portion.

13. The loop coupled microwave cavity apparatus according to claim 12, wherein the SMA connector is for impedance transforming and loop coupling and the long pin is bent to touch the inner wall of the cavity.

14. The loop coupled microwave cavity apparatus according to claim 1, wherein the cavity is formed of a metallic material.

15. The loop coupled microwave cavity apparatus according to claim 14, wherein the metallic material is copper.

16. The loop coupled microwave cavity apparatus according to claim 1, wherein a diminutive sample is disposed inside the cavity in order to measure dielectric characteristics of the diminutive sample.

17. A microwave cavity apparatus for use in measuring dielectric characteristics, comprising:

a cavity, having a cylindrical cross section and closed at both ends, one end having a lock hole; and a loop coupler, inserted into the lock hole, for impedance transforming and loop coupling, the loop coupler comprising:

a receiving end for receiving a microwave signal; and an excitation portion, protruding from the lock hole into the cavity when the loop coupler is inserted into the lock hole, including:

a loop coupling part, connected to the receiving end, having a bending part being in contact with the inner wall of the cavity;

wherein the excitation portion transmits the microwave signal and excites the cavity with the microwave signal, and the microwave cavity apparatus is excited in $TM_{012}$ mode.

18. A microwave cavity apparatus for use in measuring dielectric characteristics, comprising:

a cavity, having a cylindrical cross section and closed at both ends, one end having a lock hole; and a loop coupler, inserted into the lock hole, for impedance transforming and loop coupling, the loop coupler comprising:

a receiving end for receiving a microwave signal; and an excitation portion, protruding from the lock hole into the cavity when the loop coupler is inserted into the lock hole, including:

a loop coupling part, connected to the receiving end, having a bending part being in contact with the inner wall of the cavity;

wherein the excitation portion transmits the microwave signal and excites the cavity with the microwave signal, and the lock hole is mushroom-shaped.

19. The microwave cavity apparatus according to claim 18, wherein the cavity has a side hole for inserting a diminutive sample into the cavity in order to measure dielectric characteristics of the diminutive sample.

20. The microwave cavity apparatus according to claim 19, wherein the microwave cavity apparatus is excited in $TM_{012}$ mode.

21. The microwave cavity apparatus according to claim 19, wherein the dielectric characteristics of the diminutive sample are measured by performing a cavity perturbation method.

22. The microwave cavity apparatus according to claim 19, wherein the loop coupler is an SMA connector having a long pin to form the excitation portion.

23. The microwave cavity apparatus according to claim 22, wherein the long pin of the SMA connector is used as the loop coupling part and has the bending part touching the inner wall of the cavity.

24. The microwave cavity apparatus according to claim 19, wherein the cavity is formed of a metallic material.

25. The microwave cavity apparatus according to claim 19, wherein the cavity is a cylinder of circular cross section.

26. The microwave cavity apparatus according to claim 18, wherein the bending part is in contact with the inner wall of the cavity by turning the loop coupler around after the loop coupler is inserted into the lock hole.

27. The microwave cavity apparatus according to claim 18, wherein the cavity is a cylinder having a circular cross section.

28. The microwave cavity apparatus according to claim 18, wherein a diminutive sample can be disposed inside the cavity to measure dielectric characteristics of the diminutive sample.

29. The microwave cavity apparatus according to claim 28, wherein the dielectric characteristics of the diminutive sample are measured by a cavity perturbation method.

30. The microwave cavity apparatus according to claim 18, wherein the loop coupler is an SMA connector having a long pin to form the excitation portion.

31. The microwave cavity apparatus according to claim 30, wherein the long pin of the SMA connector is used as the loop coupling part and has the bending part touching the inner wall of the cavity.

32. The microwave cavity apparatus according to claim 18, wherein the cavity is formed of a metallic material.

* * * * *